United States Patent [19]

Camprubi

[11] 4,071,056

[45] Jan. 31, 1978

[54] LANCE DRIVING MECHANISM FOR SHUTTLELESS LOOMS

[75] Inventor: Amselmo Bolea Camprubi, Barcelona, Spain

[73] Assignee: Ingenieria Aplicada, S.A., Barcelona, Spain

[21] Appl. No.: 698,857

[22] Filed: June 23, 1976

[30] Foreign Application Priority Data

June 27, 1975 Spain ..... 213546

[51] Int. Cl.[2] ..... D03D 47/00

[52] U.S. Cl. ..... 139/449

[58] Field of Search ..... 139/441, 444, 445, 446, 139/449

[56] References Cited

U.S. PATENT DOCUMENTS

| | | | |
|---|---|---|---|
| 1,715,468 | 6/1929 | Moya | 139/449 |
| 2,165,890 | 7/1939 | Foster | 139/449 |
| 2,191,376 | 2/1940 | Gabler | 139/449 |
| 3,198,215 | 8/1965 | Tinkham | 139/449 |
| 3,232,321 | 2/1966 | Dewas | 139/449 |

*Primary Examiner*—Henry S. Jaudon

*Attorney, Agent, or Firm*—Toren, McGeady and Stanger

[57] ABSTRACT

A lance driving mechanism for a shuttleless loom includes a sley which is mounted for reciprocal pivotal movement, a pivotally mounted sector unit having a sector gear thereon, a lance band mounted on the sley for reciprocal movement relative thereto and lance band driving gears coupling the sector gear with the lance band to impart driving motion to the lance band upon pivotal movement of the sector unit. A connecting rod is attached between the sector unit and an eccentric crank in order to drive the sector unit. One end of the connecting rod is eccentrically mounted upon the crank and the eccentric mounting thereof is adjustable. The sector unit is mounted upon a support member which is, in turn, pivotally mounted for reciprocal motion with the sley and which includes thereon the lance band driving gears. The sector unit is mounted upon the support member for pivotal movement relative thereto about an axis other than the axis of rotation of the support member and the support member is mounted by an eccentric pivotal attachment which permits adjustable positioning of the height thereof.

4 Claims, 2 Drawing Figures

LANCE DRIVING MECHANISM FOR SHUTTLELESS LOOMS

BACKGROUND OF THE INVENTION

The present invention refers to an improved lance driving mechanism for shuttleless looms which is superior to any presently known as far as proper mechanism applications and possible use to operatively convert a shuttle loom into a shuttleless one are concerned.

U.S. application Ser. No. 583,973 refers to a mechanism comprising fundamentally lances and associated first members thereof arranged on a sley including a first rotation sector, which sector is linked to a connection rod with its other end eccentrically pinned to a plate or wheel which rotates two turns for each complete stroke of the sley. As a result there are obtained lance neutral, acceleration and deceleration points in accordance with the most suitable points or time for the purposes.

Such a mechanism having the present invention applied thereto is thus improved, firstly because of the inclusion of a sector fitted to a support engaged shaft and close to the support bottom whereto another self-rotation shaft is located, matching the sley shaft and with an eccentric unit to adjust the height of the support. This support carries a wing fitted to the sley and incorporates the band driving arrangement. Also significant is the fact that the plate rotates two turns for each sley stroke, carries eccentricity adjustment means and can be driven from the loom crankshaft or from the loom camshaft.

Also this design enables conversion of a shuttle loom into a shuttleless loom. Consequently, it envisages the replacement of the shuttle discharge, locking and control means of a conventional loom, such as: the ejection mechanism comprising cams, picking shaft, pickerstick knuckle unit, pickerstick, pickerstick sweeper and pickerstick shields; the shuttle braking mechanism such as the mechanical or oil-pneumatic dampers and locking strips; guiding mechanisms such as guides and plates; and the shuttle flight retaining mechanism such as flexible stops, movable reed systems or electronic systems. This will enable the provision of a new driving unit comprising a band discharge and guiding sub-unit and a sub-unit to correct the band motions while travelling outside the warp.

Other mechanisms such as the shuttle or "shield" position detector, mechanical push-buttons of the weft reserve in the pirn located within the shuttle and those provided for the replacement of an empty pirn by another full one may thus be eliminated or dispensed with in the new system.

SUMMARY OF THE INVENTION

Briefly, the present invention may be described as a lance driving mechanism for shuttleless looms comprising a sley mounted for reciprocal pivotal movement, a pivotally mounted sector unit including a sector gear, a lance band mounted on said sley for reciprocal motion relative thereto, lance band driving means coupling said sector gear with said lance band to impart driving motion thereto upon pivotal movement of said sector unit, a connecting rod having a first end and a second end, said first end of said connecting rod being coupled to said sector unit, crank means having said second end of said connecting rod coupled thereto to transmit reciprocal motion to said sector unit through said connecting rod, said crank means being driven to undergo two revolutions for each stroke of said sley, and a support member mounted for reciprocal pivotal movement with said sley and having mounted thereupon said lance band driving means, said sector unit being mounted upon said support member for pivotal movement relative thereto about an axis other than the axis of rotation of said support member, said support member including eccentric mounting means for permitting adjustable positioning thereof.

From the above, there may be obtained a machine which, after the conversion, will exhibit mechanical simplicity.

This conversion is essentially based upon the application of two mechanical units which function as follows:

a. One unit with rotation in the sley shaft which holds the reed and the sliding bases and over which is fitted a sectorholder oscillating along a point close to the reed and which is associated with said arm which transmits the motion to a gear unit converting the motion to a second unit with a toothed wheel at its end which engagement function on a band is to confer an alternate motion to the wheel.

b. A second unit coupled to the first one through a tiebar or connection rod which unit operates to adjust the lead point of the weft drive member or band on its travel outside the warp, and such unit taking up the motion from one of the main shafts of the loom which may be either the camshaft or the crankshaft, in order to rotate two complete turns for each full operating cycle of the sley.

The connecting point of the tiebar or connection rod with the first unit is in the form of a circular groove which enables the adjustment of the travel of the weft drive member without altering the central or transfer position of the wefts.

This relevant feature enables maintenance of the proportionality of the insertion capacity in metres per minute of the weft as related to the actual fabric width.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENT

Figure 1:
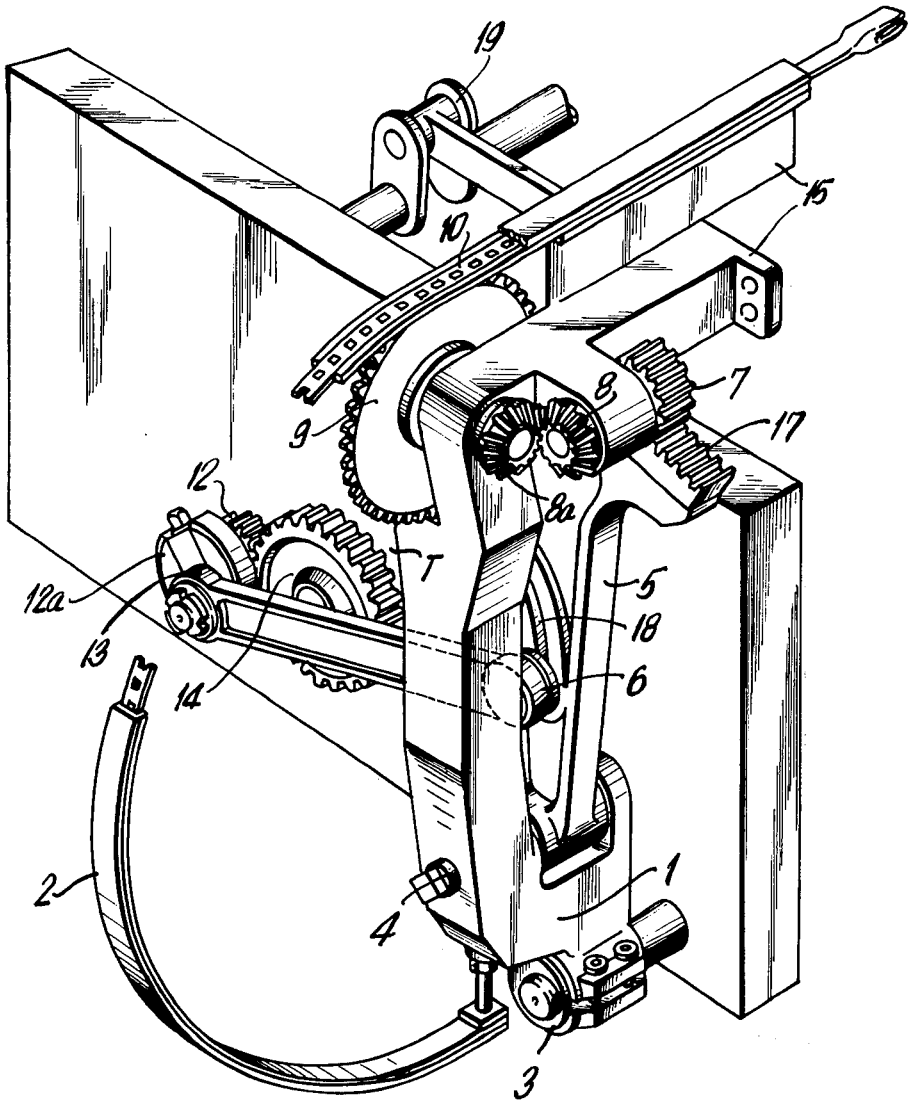
FIG. 1 is a perspective view of a loom mechanism structured in accordance with the invention, showing a first species of the invention involving one type of drive arrangement.

As shown in the drawing, a main band-holder unit is composed of a support member 1 coupled at its upper end to the sley of an existing loom thereby replacing the shuttle box or boxes. The support member 1 includes a projection 15 which is a supplemental part of the loom table or sliding base extending up to a band take-up casing 2. On its opposite end or bottom the support member 1 is attached by means of a closure system or similar mechanism to the sley swing shaft whereby it is integrally moved with the sley. Inside this closure, an eccentric bushing 3 is fitted which enables height adjustment of the unit.

On the support member 1 there is mounted a rotation shaft over which an eccentric pin 4 is fitted allowing engagement adjustment between a sector gear 17 and a motion reception pinion 7 which are concurrently applied as a knuckle and motion point of a sector unit or sector gear holder 5.

The sector unit 5 has formed therein an opposed groove 18 shaped to enable adjustment of the arc through which the sector unit 5 swings as a result of its connection to a connecting rod 6 in such a way that in the adjustment the transfer portion of the weft drive members in the center of the fabric width is not changed.

The respective swing motions between the main support member 1 and the sector unit 5 cause, as a result, rotation of the pinion 7 which at its opposite end incorporates a pair of bevel gears 8 and 8*a* which transmit this motion to a toothed wheel 9 which in turn is coupled with a weft insertion lands band 10.

The band 10 during its travel outside the warp is driven and housed within a casing 2 which swings with and is attached to the sley. The opposite end of the connecting rod 6 is connected to crank means including a grooved plate 12*a* mounted on the same shaft as a pinion 12 and having a pin base 13 securing the end of the connecting rod 6. The plate 12*a* of the crank means is adjustably mounted to change the eccentricity of the point of connection of the rod 6.

Figure 2:
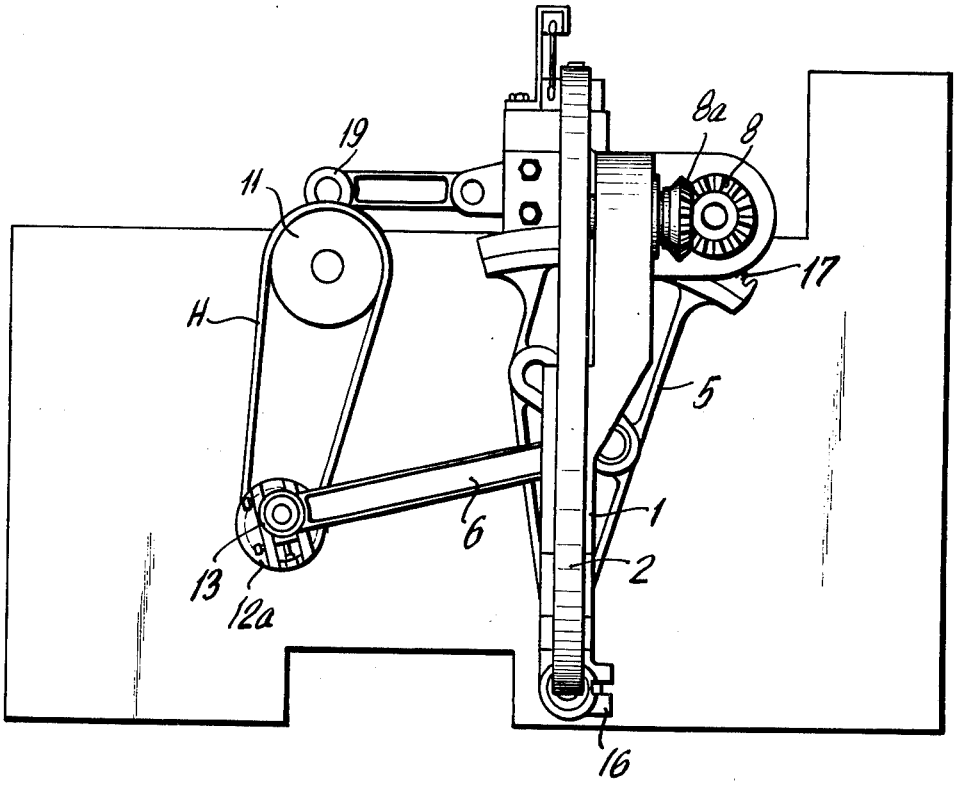
FIG. 2 is an elevational view of a second species involving a different drive arrangement.

The pinion 12 of the crank means can be selectively driven either from the camshaft holder of a driven wheel 14 or instead from the crankshaft 19 of the loom and a pulley 11 but the driving arrangement is always such that the number of pinion revolutions is double to that of the crankshaft revolutions or of the operating cycles of the looms. It will be apparent that this may be accomplished by appropriately sizing the drive elements involved. The species of the invention wherein the crank means is driven through the drive wheel 14 is shown in FIG. 1 and the other species involving drive through the crank shaft 19 is shown in FIG. 2.

With the mechanism disclosed a system operation is developed whereby the motion of the loom crankshaft causes reciprocating motion of the sley unit and, as a result, the assembly of the present invention incorporated therein including the support member 1 of the adjustable sector unit 5. Thus, the entire kinematics of the motion conversion system including that of penetration and return of the lance band 10 is affected.

However, if the sector unit 5 pivoting on the pin 4 of the support member 1 were not linked by the connection rod 6, the unit would be freely moved and no motion whatsoever would be originated since the entire device is shifted as a single unit without modification of its respective positions.

When the sector unit 5 is connected by means of the connection rod 6 to the crank means or eccentric crank system embodied by the plate 12*a* and the pin 13, rotation of the pinion 12 will cause the connecting rod 6 to pivot the sector unit 5 and as a result, the toothed section gear 17 will angularly change its relative positions with respect to the unit originating rotation of the toothed wheel 9 which drives the lance band which travel would be adjustable in accordance to the connection rod linking point represented by the eccentric mounting of the end of the rod 6 on the plate 12*a*.

Furthermore, if the connecting rod opposite end is connected to a point for eccentric rotation and adjustable operation under these conditions a sector motion control is obtained so that during a controllable travel by means of the pin eccentricity there will be no relative motion between the sector unit and the gear.

From this position, inasmuch as the sley travel is greater than that of the pin eccentricity, it is possible to impart motion to the pinion 7 through the sector gear 17, such as when 180° of the cam rotation is exceeded. The motion will be opposite to that of the sley whereby an over acceleration of the band will be initiated.

In the area close to the weft transfer where half a revolution of the loom will be accomplished, the camshaft is in such a position that its transmission ratio will be twice that of the loom operating cycle, and it will undergo a complete rotation which, on being completed, will cause motion deceleration. Thereafter, a reverse motion will be developed which terminates in a dead point of the band travel when the bands have moved out of the warp.

While a specific embodiment of the invention has been shown and described in detail to illustrate the application of the inventive principles, it will be understood that the invention may be embodied otherwise without departing from such principles.

I claim:

1. A lance driving mechanism for shuttleless looms comprising a sley mounted for reciprocal pivotal movement, a pivotally mounted sector unit including a sector gear, a lance band mounted on said sley for reciprocating motion relative thereto, lance band driving means coupling said sector gear with said lance band to impart driving motion thereto upon pivotal movement of said sector unit, a connecting rod having a first end and a second end, said first end of said connecting rod being coupled to said sector unit, crank means having said second end of said connecting rod coupled thereto to transmit reciprocal motion to said sector unit through said connecting rod, said crank means being driven to undergo two revolutions for each stroke of said sley, and a support member mounted for reciprocal pivotal motion with said sley and having mounted thereupon said lance band driving means, said sector unit being mounted upon said support member for pivotal movement relative thereto about an axis other than the axis of rotation of said support member, said support member including eccentric mounting means for permitting adjustable positioning thereof.

2. A mechanism according to claim 1 wherein said crank means is arranged to have said second end of said connecting rod eccentrically connected thereto, said mechanism further including adjustment means for enabling adjustment of the eccentricity of said second end relative to said crank means.

3. A mechanism according to claim 1 wherein said lance band driving means include a toothed wheel mounted for rotation upon said support member, bevel gear means also mounted for rotation upon said support member and a spur gear mounted for rotation upon said support member and engaging said sector gear, with reciprocal movement of said sector unit relative to said support member operating to impart rotational movement to said toothed wheel through said bevel gears in order to drive said lance band.

4. A mechanism according to claim 1 wherein said first end of said connecting rod is attached to said sector unit by means of a slot enabling relative movement between said sector unit and said first band when said sector unit is driven by said connecting rod.

* * * * *